United States Patent [19]

Vogt, deceased et al.

[11] 4,297,317

[45] Oct. 27, 1981

[54] LOW LEVEL CHROMATE-BASED CORROSION INHIBITION IN AQUEOUS MEDIUMS

[75] Inventors: Frederick G. Vogt, deceased, late of Philadelphia, Pa., by Mary J. Vogt, executrix; Patricia T. Sparrell, Freehold, N.J.

[73] Assignee: Betz Laboratories, Inc., Trevose, Pa.

[21] Appl. No.: 134,812

[22] Filed: Mar. 28, 1980

[51] Int. Cl.[3] ..... C23F 11/12; C23F 11/14; C23F 11/18

[52] U.S. Cl. ..... 422/16; 252/389 R; 252/392; 422/17; 422/19

[58] Field of Search ..... 422/16, 17, 19; 252/389 R, 392, 396

[56] References Cited

U.S. PATENT DOCUMENTS

| | | | |
|---|---|---|---|
| 3,658,710 | 4/1972 | Puckonus et al. | 422/16 X |
| 3,963,636 | 6/1976 | Harns et al. | 422/17 X |
| 4,029,577 | 6/1977 | Godlewski et al. | 210/701 |
| 4,209,398 | 6/1980 | Ii et al. | 422/17 X |

*Primary Examiner*—Barry Richman

*Attorney, Agent, or Firm*—Alexander D. Ricci; Bruce E. Peacock

[57] ABSTRACT

A method and composition are disclosed for treating corroding aqueous mediums to reduce the corrosion of metal surfaces exposed thereto. The treatment comprises water-soluble chromate and a copolymer of acrylic acid and hydroxy alkyl acrylate.

20 Claims, No Drawings

LOW LEVEL CHROMATE-BASED CORROSION INHIBITION IN AQUEOUS MEDIUMS

TECHNICAL BACKGROUND

Chromates are widely referred to in the literature, and their effectiveness in reducing the rate of corrosion of metallic surfaces exposed to corroding aqueous mediums is well known. However, if used in low concentrations these inhibitors can cause considerable pitting and tuberculation. Indeed, if added in insufficient quantities to stop metal surface attack altogether, corrosion can become so severely localized and the intensity of attack so intense that perforations may occur more extensively than if no inhibitor treatment had been added.

In *Corrosion Inhibitors,* 3rd edition; National Association of Corrosion Engineers; Houston, Texas (1977); p. 134, it is stated that the critical concentration for passivation by chromate in distilled water is 81 to 162 ppm and that the critical level for chromate increases as chloride and sulfate levels increase. Present practice in industrial water systems is to employ chromates alone in concentrations no lower than 200 ppm.

Economic and environmental considerations make it desirable to minimize chromate levels in water. This goal has been attained by combining the chromate with other compounds such as phosphate and zinc. For example, U.S. Pat. No. 2,711,391 to Kahler discloses the use of water-soluble chromate in combination with water-soluble phosphate. According to this reference, the combined treatment permits the use of lower levels of chromate than had theretofore been used. However, the lowest dosage rate for chromate achievable, according to Kahler, is 5 ppm. In fact, the reference specifically sets the preferred lower limit for chromate at 11 ppm. U.S. Pat. No. 2,900,222 to Kahler et al teaches the use of chromate compound at levels as low as 1 ppm, but only in combination with both water-soluble orthophosphate and water-soluble zinc compound. A problem related to supplemented chromate treatments such as those disclosed in the Kahler references is that the discharge of industrial waters containing heavy metals and/or phosphorous compounds is under strict environmental control. The quality of water discharged to natural waters is presently being regulated and is expected to be under greater scrutiny in the future.

DESCRIPTION OF PRESENT INVENTION

According to the present invention, a chromate-based corrosion inhibitor for metal surfaces exposed to a corroding aqueous medium consists essentially of (i) water-soluble chromate and (ii) a particular type of water-soluble polymer comprised of moieties derived from acrylic acid or derivatives thereof (AA) and hydroxylated lower alkyl acrylate moieties (HAA). It was unexpectedly discovered that when combined with the polymer, very low levels of chromate could successfully be used for corrosion inhibition in aqueous mediums without the use of additional treatment compounds such as zinc and phosphate. In those systems treated with this essentially two-component combination; zinc, a heavy metal, and phosphate, a compound which causes eutrophication, can be eliminated. Accordingly, not only would a treatment in accordance with the present invention be less toxic, but it would also be less expensive than, for example, a four-component treatment which also includes zinc and phosphate.

In the context of permitting the deletion of zinc from a corrosion inhibitor treatment, methods according to the present invention would comprise the use of zinc-free corrosion inhibitor treatments comprising components (i) and (ii) as defined above. In the context of permitting the deletion of both zinc and phosphate, methods according to the present invention would comprise the use of zinc-free and phosphate-free corrosion inhibitors comprising the noted components (i) and (ii).

From an environmental acceptability point of view, chromate levels of less than 5 ppm of active chromate are most desirable. However, at such low levels pitting is extremely severe. It was unexpectedly discovered that a corrosion inhibitor treatment comprising less than 5 ppm water-soluble chromate in combination with AA/HAA significantly reduced such pitting. Accordingly, the present invention is also considered to be related to a corrosion inhibitor treatment comprising water-soluble chromate and AA/HAA wherein the chromate is added in an amount of less than 5 parts of active chromate per million parts of aqueous medium.

Although the present invention is considered to have applicability to any aqueous system, it is particularly useful in cooling water systems. Accordingly, the present invention will hereinafter be described as it relates to cooling water systems.

THE POLYMER

The polymers according to the present invention are those effective for the purpose which contain essentially moieties derived from an acrylic acid compound (AA), i.e.,

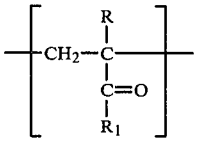

(I)

where R is hydrogen or a lower alkyl of from 1 to 3 carbon atoms and $R_1$=OH, $NH_2$ or OM, where M is a water-soluble cation, e.g., $NH_4$, alkali metal (K, Na), etc; and moieties of an hydroxylated lower alkyl ($C_2$–$C_6$) acrylate (HAA) as represented, for example, by the formula:

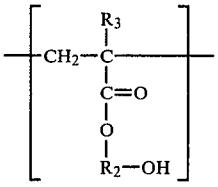

(II)

where $R_3$ is H or lower alkyl of from 1 to 3 carbon atoms, and $R_2$ is a lower alkyl having from about 2 to 6 carbon atoms.

In terms of mole ratios, the polymers are considered, most broadly, to have a mole ratio of AA:HAA of from about 1:4 to 36:1. This mole ratio is preferably about 1:1 to 11:1, and most preferably about 1:1 to 5:1. The only criteria that is considered to be of importance with respect to mole ratios is that it is desirable to have a copolymer which is water-soluble. As the proportion of hydroxylated alkyl acrylate moieties increases, the solubility of the copolymer decreases. It is noted that, from an efficacy point of view, the polymers having a mole ratio of AA:HAA of 1:1 to 5:1 are considered the best.

The polymers could have a molecular weight of from about 1,000 to about 50,000 with from about 2,000 to about 6,000 being preferred.

The polymers utilized in accordance with the invention can be prepared by vinyl addition polymerization or by treatment of an acrylic acid or salt polymer. More specifically, acrylic acid or derivatives thereof or their water soluble salts, e.g., sodium, potassium, ammonium, etc. can be copolymerized with the hydroxy alkyl acrylate under standard copolymerization conditions utilizing free radical initiators such as benzoyl peroxide, azobisisobutyronitrile or redox initiators such as ferrous sulfate and ammonium persulfate. The molecular weight of the resulting copolymer can be controlled utilizing standard chain control agents such as secondary alcohols (isopropanol), mercaptans, halocarbons, etc. Copolymers falling within the scope of the invention are commercially available from, for example, National Starch Company.

The hydroxy alkyl acrylate can be prepared by the addition reaction between the acrylic acid or its derivatives or water soluble salts and the oxide of the alkyl derivative desired. For example, the preferred monomer of the present invention is the propyl derivative. Accordingly, to obtain the hydroxylated monomer, acrylic acid is reacted with propylene oxide to provide the hydroxypropyl acrylate monomer.

The polymers of the invention may also be prepared by reacting a polyacrylic acid or derivative thereof with an appropriate amount of an alkylene oxide having from 2 to 6 carbon atoms such as ethylene oxide, propylene oxide and the like. The reaction takes place at the COOH or COM group of the moieties to provide the hydroxylated alkyl acrylate moiety.

The polymer prepared either by copolymerization of AA with hydroxypropyl acrylate (HPA) or reaction of AA with propylene oxide would be composed primarily of units or moieties having the structural formulas:

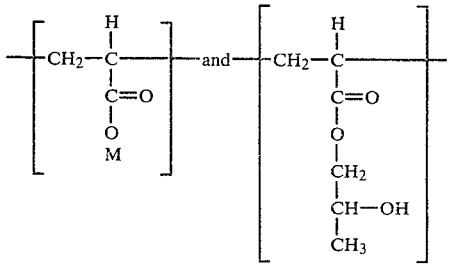

where M is as earlier defined. It is noted that in aqueous solution the hydroxypropyl acrylate moiety is in equilibrium with a minor amount of 1-methyl-2-hydroxyethyl acrylate.

THE CHROMATE COMPOUNDS

Illustrative examples of chromate compounds which could be used in practicing methods according to the present invention are described in U.S. Pat. No. 2,900,222 to Kahler et al which patent is incorporated herein by reference. These compounds would include alkali metals or any water-soluble compound that contains hexavalent chromate and provides chromate radical in water solutions. Illustrative water-soluble chromate compounds are sodium chromate dihydrate, sodium chromate anhydrous, sodium chromate tetrahydrate, sodium chromate hexahydrate, sodium chromate decahydrate, potassium dichromate, potassium chromate, ammonium dichromate and chromic acid.

The amount of each constituent added to the cooling water would, of course, be an effective amount for the purpose and would depend on such factors as the nature and severity of the corrosion problem being treated and the temperature and pH of the cooling water.

In terms of active polymer, as little as about 0.5 part per million parts of cooling water (ppm) should be effective, while about 2 ppm is the preferred lower limit. Based on economic considerations, the polymer could be fed in amounts as high as about 200 ppm, with about 50 ppm being the preferred upper limit.

In terms of active chromate, that is, active hexavalent chromate ion, as little as about 0.5 ppm should be effective. The upper limit would depend on such factors as cost and toxicity and could be as high as about 150 ppm. The preferred upper limit is about 50 ppm. It is most preferred that the chromate be fed in amounts which are less than 5 ppm.

Methods for feeding corrosion inhibitors to cooling water are well known in the art such that details thereof are not considered necessary. The treatment is preferably used as an aqueous solution. The constituents are combined by simply adding them to water. Should long-term stability problems be experienced, a two-barrel treatment may be more desirable. Of course, the constituents could be combined in any relative proportions in dry form.

Based on experience, compositions according to the present invention could vary widely and could comprise, on a weight basis:

(i) about 1 to 99% of AA/HAA polymer, and (ii) about 1 to 99% of active chromate (as defined above) of the total amount of polymer and active chromate. The preferred relative proportions would be about 10 to 90% AA/HAA and about 10 to 90% active chromate of the total amount of polymer and active chromate.

It is possible for the cooling water to have a pH of about 5.5 to 9.5. More commonly, the pH is about 6.5 to 8.5, with about 6.5 to 7.5 being most common.

With respect to the best mode for practicing the present invention, it is believed that methods and compositions in accordance therewith could best be used, with significant economic advantage, in the following systems:

1. in waters with low hardness, where low hardness is defined as less than 100 ppm of calcium as calcium carbonate and less than 100 ppm of magnesium as calcium carbonate;
2. in waters with a negative Langelier Saturation Index, as defined in the "BETZ Handbook of Industrial Water Conditioning", Seventh Edition; Betz Laboratories, Inc.; Trevose, Pa. (1976); pp 178–180;
3. in waters with a corrosion and/or calcium phosphate deposition problem (the phosphate can be a constituent of the makeup water); and
4. in waters with a corrosion and/or calcium sulfate, silt or iron oxide fouling problem.

EXAMPLES

EXAMPLE 1

To demonstrate the corrosion inhibition efficacy of the combination of chromate and AA/HAA polymer, various mixtures were prepared by dissolving varying ratios of the components in water. The combinations were tested using a spinner testing technique.

The tests were each conducted with two non-pretreated low carbon steel coupons which were immersed and rotated in aerated synthetic cooling water for a 3- or 4-day period. The water was adjusted to the desired pH and readjusted after one day if necessary; no further adjustments were made. Water temperature was 120° F., and rotational speed was maintained to give a water velocity of 1.3 feet per second past the coupons. The total volume of water was 17 liters. Cooling water was manufactured to give the following conditions:

Ca as $CaCO_3$=400 ppm
Mg as $CaCO_3$=200 ppm
Chloride ion=281 ppm
Sulfate ion=192 ppm Corrosion rate was determined by weight loss measurement. Prior to immersion, coupons were scrubbed with a mixture of trisodium phosphate-pumice, rinsed with water, rinsed with isopropyl alcohol and then air dried. Weight measurement to the nearest milligram was made. At the end of one day, a weighed coupon was removed and cleaned. Cleaning consisted of immersion into a 50% solution of HCl for approximately 20 seconds, rinsing with tap water, scrubbing with a mixture of trisodium phosphate-pumice until clean and then rinsing with tap water and isopropyl alcohol. When dry, a second weight measurement to the nearest milligram was made. At the termination of the tests, the remaining coupon was removed, cleaned and weighed.

Corrosion rates were calculated by differential weight loss according to the following equation:

$$\text{Corrosion Rate} = \frac{N^{th}\text{ Day Weight Loss} - 1^{st}\text{ Day Weight Loss}}{N-1}$$

where N=3 or 4.

The results of these tests are reported below in TABLE 1 in terms of percent (%) corrosion inhibition of various treatments as compared to an untreated control test. The polymer tested was an acrylic acid/hydroxypropyl acrylate copolymer (AA/HPA) having a mole ratio of AA to HPA of 3:1 and a nominal molecular weight of 6000. The chromate compound used was sodium dichromate dihydrate. The amounts of chromate reported are active chromate dosages in ppm, and the pH of the test water was 8. The corrosion rates are reported in mils per year (mpy).

TABLE 1

| Test | Polymer (ppm) | $CrO_4^=$ (ppm) | Corrosion Rate (mpy) | % Corrosion Inhibition |
|---|---|---|---|---|
| A | — | — | 143–147 | 0 |
| B | — | 1 | 120–139 | 10 |
| C | 1 | — | 145 | 0 |
| D | 1 | 1 | 86.5 | 40 |
| E | 10 | — | 83 | 43 |
| F | 10 | 1 | 43.5 | 70 |

It can be seen from TABLE 1 that the chromate-polymer combinations were quite effective in inhibiting corrosion, even at very low levels of active chromate.

EXAMPLE 2

As already noted above, the use of insufficient amounts of chromate as a corrosion inhibitor can lead to rather severe pitting of metal surfaces. The ability of chromate-polymer combinations to reduce this pitting is demonstrated in the results of additional tests which were obtained in accordance with ASTM Pit Rating Methods. According to ASTM Pit Rating Methods, the density, size and depth of such localized corrosion is measured as described in "Measurement and Evaluation of Pitting Corrosion", Galvanic and Pitting Corrosion—Field and Laboratory Studies, ASTM Method STP-576, American Society for Testing and Materials, pp. 203–216 (1976), which work is incorporated herein by reference. Testing procedures and conditions were substantially the same as those described in Example 1, with the exception that the coupons were additionally microscopically examined for pit rating.

The results of these tests are reported below in TABLES 2 and 3 in terms of ASTM Pit Ratings. In TABLE 3, some corrosion rates and % corrosion inhibition values are also reported. The polymer tested was AA/HPA having a mole ratio of AA to HPA of 3:1 and a nominal molecular weight of 6000. The chromate was sodium dichromate dihydrate. The amounts of chromate reported are active chromate dosages. The ASTM pit ratings are in terms of density, in number of pits/square decimeter ($dm^2$); pit sizes, in square millimeters ($mm^2$), and pit depths, in millimeters (mm).

TABLE 2

| Test | pH | $CrO_4^=$ (ppm) | Polymer (ppm) | ASTM Pit Rating Density | Size | Depth |
|---|---|---|---|---|---|---|
| A | 7 | 5 | — | 100–300/$dm^2$ | 0.5–2.0 $mm^2$ | ≦0.4 mm |
| B | 7 | 2.5 | 2.5 | 25–100/$dm^2$ | ≦0.5 $mm^2$ | ≦0.4 mm |

TABLE 3

| Test | pH | $CrO_4^=$ (ppm) | Polymer (ppm) | Corrosion Rate (mpy) | % Corrosion Inhibition | ASTM Pit Rating Density | Size | Depth |
|---|---|---|---|---|---|---|---|---|
| A | 5 | 1 | 0 | 122 | — | <25 $dm^2$ | ≦0.5 $mm^2$ | ≦0.4 mm |
| B | 5 | 0.5 | 0.5 | 82 | — | | No Pitting | |
| C | 5 | 0 | 1 | 93 | — | 1000–5000/$dm^2$ | ≦0.5 $mm^2$ | ≦0.4 mm |
| D | 7 | 1 | 0 | 78 | 52 | 500–1000/$dm^2$ | ≦0.5 $mm^2$ | ≦0.4 mm |
| E | 7 | 1 | 2.5 | 68 | 58 | 25–100/$dm^2$ | ≦0.5 $mm^2$ | ≦0.4 mm |
| F | 7 | 1 | 10 | 44 | 73 | <25/$dm^2$ | ≦0.5 $mm^2$ | ≦0.4 mm |

As can be seen from TABLES 2 and 3, the chromate-polymer treatment significantly reduced coupon pitting.

Having thus described our invention what is claimed is:

1. A method for reducing the amount of corrosion of metal surfaces in contact with an aqueous medium comprising adding to said aqueous medium an effective amount for the purpose of a zinc-free and phosphate-free treatment consisting essentially of effective:

(i) water-soluble chromate, and (ii) water-soluble polymer comprising moieties derived from acrylic acid or water-soluble salt thereof and moieties of hydroxylated lower alkyl acrylate, wherein the moieties of said polymer have the following formulas:

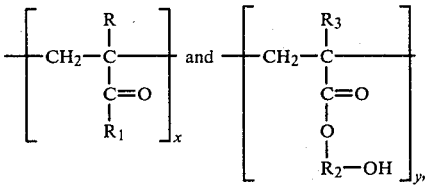

where R is hydrogen or a lower alkyl of from 1 to 3 carbon atoms; $R_1$ is OH, $NH_2$ or OM where M is a water-soluble cation; $R_2$ is a lower alkyl of from about 2 to 6 carbon atoms, $R_3$ is H or lower alkyl of from 1 to 3 carbon atoms and the mole ratio of x:y is 1:4 to 36:1, wherein said water soluble chromate is added in an amount of from about 0.5 to about 150 parts of active chromate per million parts of said aqueous medium.

2. A method according to claim 1, wherein said water-soluble polymer is added in an amount of from about 0.5 to about 200 parts of polymer per million parts of aqueous medium.

3. A method according to claim 1, wherein said polymer has a molecular weight of from about 1,000 to about 50,000.

4. A method according to claim 2, wherein said polymer has a molecular weight of from about 1,000 to about 50,000.

5. A method according to claim 4, wherein said mole ratio of x:y is 1:1 to 11:1.

6. A method according to claim 4, wherein said aqueous medium is cooling water.

7. A method according to claim 6, wherein said mole ratio of x:y is 1:1 to 11:1.

8. A method according to claim 7, wherein said water-soluble chromate is added in an amount of from about 0.5 to about 50 parts of active chromate per million parts of aqueous medium and said water-soluble polymer is added in an amount of from about 0.5 to about 50 parts of polymer per million parts of aqueous medium.

9. A method according to claim 8, wherein said mole ratio of x:y is 1:1 to 5:1.

10. A method according to claim 9, wherein said polymer has a molecular weight of from about 2,000 to about 6,000.

11. A method according to claim 10, wherein said polymer comprises a copolymer of acrylic acid or water-soluble salt thereof and 2-hydroxypropyl acrylate.

12. A method according to claim 1, 6, 8 or 10, wherein said aqueous medium has a pH of about 5.5 to 9.5.

13. A method for reducing the amount of corrosion of metal surfaces in contact with an aqueous medium comprising adding to said aqueous medium an effective amount for the purpose of an effective zinc-free and phosphate-free treatment consisting essentially of (i) water-soluble chromate, and (ii) water-soluble polymer comprising moieties derived from acrylic acid or water-soluble salt thereof and moieties of hydroxylated lower alkyl acrylate, wherein the moieties of said polymer have the following formulas:

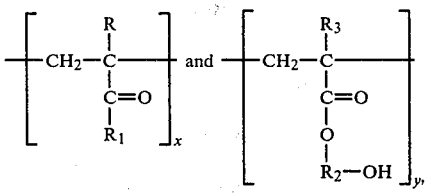

where R is hydrogen or a lower alkyl of from 1 to 3 carbon atoms; $R_1$ is OH, $NH_2$ or OM where M is a water-soluble cation; $R_2$ is a lower alkyl of from about 2 to 6 carbon atoms, $R_3$ is H or lower alkyl of from 1 to 3 carbon atoms and the mole ratio of x:y is 1:4 to 36:1, wherein said water-soluble chromate is added in an amount which is less than 5 parts of active chromate per million parts of aqueous medium.

14. A method according to claim 13, wherein said water-soluble chromate is added in an amount of from about 0.5 to less than 5 parts of active chromate per million parts of aqueous medium and said water-soluble polymer is added in an amount of from about 0.5 to about 200 parts of polymer per million parts of aqueous medium.

15. A method according to claim 13, wherein said polymer has a molecular weight of from about 1,000 to about 50,000.

16. A method according to claim 15, wherein said mole ratio of x:y is 1:1 to 11:1.

17. A method according to claim 16, wherein said polymer has a molecular weight of about 2,000 to about 6,000.

18. A method according to claim 17, wherein said ratio of x:y is 1:1 to 5:1.

19. A method according to claim 13, 15 or 14, wherein said aqueous medium is cooling water.

20. A method according to claim 19, wherein said polymer is a copolymer of acrylic acid or water-soluble salt thereof and 2-hydroxypropyl acrylate.

* * * * *